United States Patent [19]

McKnight et al.

[11] Patent Number: 5,050,476

[45] Date of Patent: Sep. 24, 1991

[54] THERMALLY MARKED TARGET MISSILE SYSTEM

[75] Inventors: William B. McKnight, Huntsville; Thomas E. Honeycutt, Athens; Walter B. Jennings, Jr., Toney, all of Ala.

[73] Assignee: The United States of America as represented by the Secretary of the Army, Washington, D.C.

[21] Appl. No.: 408,885

[22] Filed: Oct. 30, 1973

[51] Int. Cl.[5] ..... F41G 7/22

[52] U.S. Cl. ..... 89/1.11; 244/3.16

[58] Field of Search ..... 244/3.16, 3.15, 3.13; 89/1.11

[56] References Cited

U.S. PATENT DOCUMENTS

| | | | |
|---|---|---|---|
| 3,743,216 | 7/1973 | Salonimer | 244/3.16 |
| 3,754,249 | 8/1973 | Kearney, II | 244/3.13 |
| 3,780,967 | 12/1973 | Evers et al. | 244/3.16 |

*Primary Examiner*—Charles T. Jordan

*Attorney, Agent, or Firm*—Nathan Edelberg; Herbert H. Murray

[57] ABSTRACT

The missile system disclosed herein involves directing a beam from a moderately powered laser on a taget for such time that a hot spot is produced. This hot spot is then used as a target for a cooperating infrared seeking missile.

3 Claims, 1 Drawing Sheet

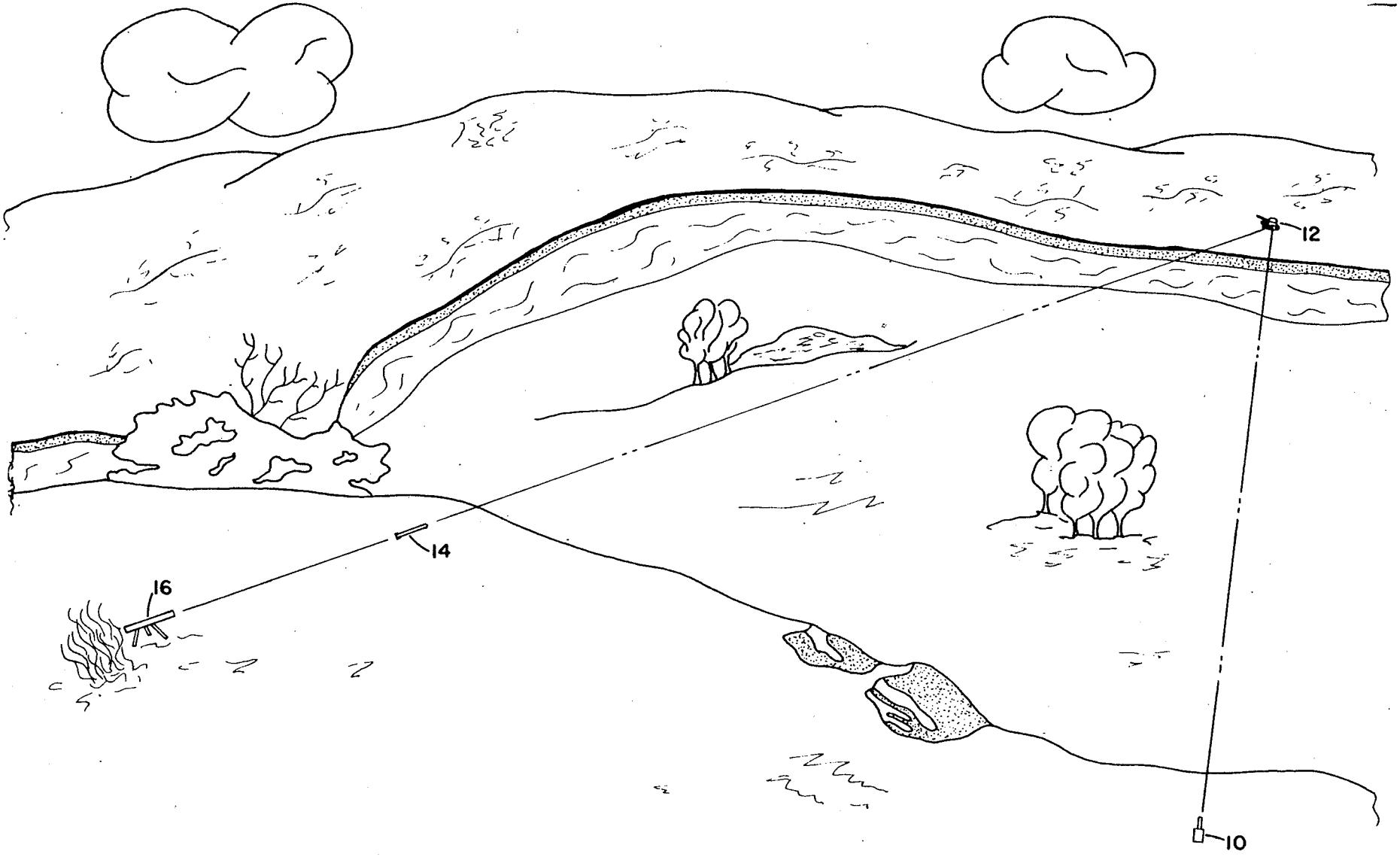
12
10
14
16

THERMALLY MARKED TARGET MISSILE SYSTEM

BACKGROUND OF THE INVENTION

Previous missile systems for use against tanks and trucks required continuous guidance of the missile to the target or a heat seeking missile which homed in on the heat of the engine of the target vehicle.

It is an object of this invention to provide a missile system which does not require continuous operator guidance of the missile to the target, or continuous laser illumination.

A further object of the invention is to provide a missile system which employs a heat seeking missile which is effective against parked targets.

BRIEF DESCRIPTION OF THE DRAWING

The single FIGURE of the drawing is an artist's conception illustrating the missile system of the present invention.

DETAILED DESCRIPTION OF THE INVENTION

Referring now to the drawing, the missile system of the present invention uses a laser 10 for thermally marking a target 12 creating a hot spot on the target. A heat seeking missile 14 launched from a launcher 16 then homes in on the hot spot thus created. The launcher may be located adjacent the laser or remote therefrom as illustrated.

The following table represents five different seekers contemplated for use in heat seeking missiles for the missile system described herein.

TABLE I

| Sensor | Threshold (watts/cm²) | Band (microns) | Target Emission Power (normal to sensor) (watts) 1 km | 2 km | 3 km | Background at 30° C. (watts/cm²) |
|---|---|---|---|---|---|---|
| 1 | $6 \times 10^{-11}$ | 3-5 | 1.885 | 7.55 | 17.0 | $7.5 \times 10^{-4}$ |
| 2 | $2 \times 10^{-12}$ | 3-5 | 0.0628 | 0.251 | 0.565 | $7.5 \times 10^{-4}$ |
| 3 | $2 \times 10^{-11}$ | 8-14 | 0.628 | 2.51 | 5.65 | 0.212 |
| 4 | $3 \times 10^{-11}$ | 2.72-3.30 | 0.942 | 3.77 | 8.50 | $0.17 \times 10^{-4}$ |
| 5 | $4.5 \times 10^{-11}$ | 2.8-3.6 | 1.42 | 5.67 | 12.75 | $0.45 \times 10^{-4}$ |

The laser power required for use with the several seekers depends further on the legnth of time the laser is turned on, the size of the spot illuminated, the time delay of acquisition and launch of the missile and the range to the target. The following charts show the laser power required for the several variables stated.

TABLE II

SENSOR #1

| Spot Size $r_o$ (cm) | Beam Time $\tau$ (sec) | Delay $\tau_d$ (sec) | Laser Power (kW) at Range $R_o$ 1 km | 2 km | 3 km | Closure Speed $V_c$ at $R_o$ = 1 km (m/sec) |
|---|---|---|---|---|---|---|
| 5 | 1 | 1 | 63 | 100 | 126 | 375 |
| | | 5 | 120 | 200 | 250 | 125 |
| | 3 | 1 | 26 | 42 | 57 | 125 |
| | | 5 | 43 | 72 | 93 | 100 |
| | 10 | 1 | 11 | 18 | 23 | 90 |
| 25 | 1 | 1 | 365 | 780 | 1130 | 250 |
| | | 5 | 740 | 1440 | 1950 | 65 |
| | 3 | 1 | 143 | 325 | 415 | 125 |
| | | 5 | 230 | 470 | 650 | 60 |
| | 10 | 1 | 70 | 130 | | 60 |
| 50 | 3 | 1 | 260 | 690 | 1150 | 125 |

TABLE II-continued

SENSOR #1

| Spot Size $r_o$ (cm) | Beam Time $\tau$ (sec) | Delay $\tau_d$ (sec) | Laser Power (kW) at Range $R_o$ 1 km | 2 km | 3 km | Closure Speed $V_c$ at $R_o$ = 1 km (m/sec) |
|---|---|---|---|---|---|---|
| | | 5 | 450 | 1150 | 1850 | 50 |

TABLE III

SENSOR #2

| Spot Size $r_o$ (cm) | Beam Time $\tau$ (sec) | Delay $\tau_d$ (sec) | Laser Power (kW) at Range $R_o$ 1 km | 2 km | 3 km | Closure Speed $V_c$ at $R_o$ = 1 km (m/sec) |
|---|---|---|---|---|---|---|
| 5 | 1 | 1 | 14.2 | 28 | 40 | 250 |
| | | 5 | 27 | 54 | 70 | 85 |
| | 3 | 1 | 6.3 | 12 | 17 | 125 |
| | | 5 | 7.8 | 21 | 28 | 90 |
| | 10 | 1 | 2.8 | 5.0 | 7.3 | 70 |
| 25 | 1 | 1 | 24 | 78 | 165 | 125 |
| | | 5 | 36 | 144 | 310 | 40 |
| | 3 | 1 | 11 | 33 | 73 | 60 |
| | | 5 | 13 | 46 | 100 | 50 |
| | 10 | 1 | 3.9 | 14.5 | 30 | 40 |
| 50 | 3 | 1 | | 47 | 75 | 100 |
| | | 5 | | 66 | 130 | 45 |

TABLE IV

SENSOR #3

| Spot Size $r_o$ (cm) | Beam Time $\tau$ (sec) | Delay $\tau_d$ (sec) | Laser Power (kW) at Range $R_o$ 1 km | 2 km | 3 km | Closure Speed $V_c$ at $R_o$ = 1 km (m/sec) |
|---|---|---|---|---|---|---|
| 5 | 1 | 1 | 15 | 44 | 82 | 40 |
| | | 5 | 29 | 85 | 160 | 80 |
| | 3 | 1 | 6.3 | 20 | 36 | 18 |
| | | 5 | 11 | 32 | 58 | 60 |
| 25 | 1 | 1 | 20 | 67 | 157 | 80 |
| | | 5 | 32 | 140 | 280 | 140 |
| | 3 | 1 | 9 | 29 | 65 | 35 |
| | | 5 | 13 | 54 | 100 | 50 |

TABLE V

SENSORS #4 AND 5

| Spot Size $r_o$ (cm) | Beam Time $\tau$ (sec) | Delay $\tau_d$ (sec) | Laser Power (kW) at Range $R_o$ 1 km | 2 km | 3 km | Closure Speed $V_c$ at $R_o$ = 1 km (m/sec) |
|---|---|---|---|---|---|---|
| Sensor 4 | | | | | | |
| 5 | 3 | 1 | 36 | 50 | 66 | 300 |
| | | 5 | 65 | 87 | 115 | 150 |
| Sensor 5 | | | | | | |
| 5 | 3 | 1 | 37 | 52 | 65 | 300 |
| | | 5 | 65 | 90 | 115 | 150 |

The above tables give figures representative of thick steel targets for various ranges up to 3 km and various times of exposure and spot sizes.

The following table gives similar figures for use of the system against relatively thin aluminum targets.

TABLE VI

| | |
|---|---|
| Spot Size: | $r_o$ = 5 cm |
| Thickness: | c = 0.3 cm |
| Beam Time: | $\tau$ = 3 sec |
| Delay: | $\tau_d$ = 5 sec |
| Convection: | h = 0.002 cal/cm$^2$ sec °K. |

| | Laser Power (kW) | | | | | |
|---|---|---|---|---|---|---|
| | $\bar{a} = \epsilon = 0.2$ | | | $\bar{a} = 0.5$ $\epsilon = 0.7$ | | |
| | Range | | | Range | | |
| Sensor | 1 km | 2 km | 3 km | 1 km | 2 km | 3 km |
| 1 | 43 | 70 | 95 | 11.6 | 18 | 24 |
| 2 | 11 | 20 | 29 | 1.9 | 4.7 | 7 |
| 3 | 14 | 40 | 70 | 2 | 6 | 11 |
| 4 | 61 | 88 | 115 | 17.4 | 25.2 | 31.2 |
| 5 | 60 | 89 | 106 | 12.2 | 16.4 | 21.2 |
| | Plate Thickness: c = 0.2 cm | | | | | |
| 4 | 42 | 60 | 75 | 17.4 | 25.2 | 31.4 |
| 5 | 41 | 61 | 77 | 6.5 | 19.0 | 21.2 |

In general it can be seen from the above charts that a medium powered laser 50 kw to 150 kw with an average laser application time of approximately three seconds will create a hot spot suitale for use with most all of the different types of seekers at ranges up to 3 km.

We claim:

1. A missle system for intercepting a target including:

a high power laser for heating said target for from 1 to 5 seconds to thermally mark said target by creating a hot spot thereon; and a heat seeking missile for intercepting said target by homing in on the heat radiating from said hot spot after said laser heating is removed.

2. A missile system as set forth in claim 1 wherein said laser is between 50 kw and 150 kw in power.

3. A missile system as set forth in claim 2 wherein the time for the seeker in said missile to lock onto said hot spot is from 1 to 5 seconds.

* * * * *